US010132135B2

(12) United States Patent
Gaude

(10) Patent No.: US 10,132,135 B2
(45) Date of Patent: Nov. 20, 2018

(54) SUBSEA DRILLING SYSTEM WITH INTENSIFIER

(71) Applicant: Cameron International Corporation, Houston, TX (US)

(72) Inventor: Edward C. Gaude, Tomball, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 14/819,175

(22) Filed: Aug. 5, 2015

(65) Prior Publication Data

US 2017/0037702 A1 Feb. 9, 2017

(51) Int. Cl.

| | |
|---|---|
| ***E21B 34/04*** | (2006.01) |
| ***E21B 33/035*** | (2006.01) |
| ***E21B 33/06*** | (2006.01) |
| ***E21B 34/16*** | (2006.01) |

(52) U.S. Cl.

CPC ..... *E21B 34/045* (2013.01); *E21B 33/0355* (2013.01); *E21B 33/06* (2013.01); *E21B 34/16* (2013.01)

(58) Field of Classification Search

CPC ..... E21B 33/064; E21B 34/045

See application file for complete search history.

(56) References Cited

U.S. PATENT DOCUMENTS 3,743,013 A * 7/1973 Harbonn ..... F15B 1/02 166/368
4,147,221 A * 4/1979 Ilfrey ..... E21B 7/128 166/339
4,167,215 A * 9/1979 Thorne ..... E21B 33/035 166/337
4,171,922 A * 10/1979 Coulboy ..... E21B 33/038 166/341
4,955,195 A * 9/1990 Jones ..... E21B 34/16 137/1
5,101,907 A * 4/1992 Schultz ..... E21B 23/04 166/319
6,032,742 A * 3/2000 Tomlin ..... E21B 33/063 166/345
6,192,680 B1 * 2/2001 Brugman ..... E21B 33/0355 60/398
6,227,300 B1 * 5/2001 Cunningham ..... E21B 33/035 166/339
6,776,080 B2 8/2004 Hansen et al.
7,107,766 B2 * 9/2006 Zacche' ..... A23L 3/0155 60/413

(Continued)

FOREIGN PATENT DOCUMENTS

WO 2015017662 A1 2/2015

*Primary Examiner* — Matthew R Buck
*Assistant Examiner* — Aaron L Lembo
(74) *Attorney, Agent, or Firm* — Helene Raybaud

(57) ABSTRACT

A subsea drilling system that includes a blowout preventer (BOP) stack with accumulators. The drilling system also includes an intensifier that is cyclable to communicate an increased pressure to the accumulators than that provided by surface equipment so as to charge the accumulators with the increased pressure. The subsea drilling system also includes a control system locatable subsea that operates the intensifier to pump fluid into the accumulators.

20 Claims, 4 Drawing Sheets

(56) References Cited

U.S. PATENT DOCUMENTS 7,159,662 B2 * 1/2007 Johansen ..... E21B 23/04 166/319
7,665,527 B2 * 2/2010 Loretz ..... E21B 23/04 166/319
7,921,917 B2 * 4/2011 Kotrla ..... E21B 33/035 166/339
8,220,773 B2 * 7/2012 Gustafson ..... E21B 33/0355 166/364
8,322,429 B2 * 12/2012 Judge ..... E21B 33/064 166/341
8,448,915 B2 * 5/2013 Baugh ..... E21B 33/063 166/85.4
8,453,762 B2 * 6/2013 Law ..... E21B 19/086 137/14
8,490,705 B2 * 7/2013 Curtiss, III ..... E21B 34/16 166/250.1
9,045,959 B1 * 6/2015 Lugo ..... E21B 33/035
9,140,090 B2 * 9/2015 Van Wijk ..... E21B 33/0355
9,222,326 B2 * 12/2015 Whitby ..... E21B 33/0355
9,637,994 B2 * 5/2017 Nellessen, Jr. ..... E21B 33/0355
2005/0178560 A1 * 8/2005 Johansen ..... E21B 23/04 166/374
2007/0163782 A1 * 7/2007 Keener ..... E21B 19/002 166/358
2008/0264646 A1 * 10/2008 Sten-Halvorsen ..... E21B 33/0355 166/360
2009/0294130 A1 * 12/2009 Rodriguez ..... E21B 33/064 166/341
2011/0005770 A1 * 1/2011 Scranton ..... E21B 34/045 166/363
2012/0138159 A1 * 6/2012 Wordley ..... E21B 33/0355 137/15.01
2012/0216889 A1 8/2012 Eide et al.
2012/0279720 A1 * 11/2012 Whitby ..... E21B 33/0355 166/363
2012/0305258 A1 12/2012 Baugh
2012/0324876 A1 12/2012 Fuselier et al.
2013/0098628 A1 * 4/2013 Van Wijk ..... E21B 33/0355 166/368
2013/0175045 A1 * 7/2013 Rytlewski ..... E21B 33/0355 166/363
2014/0034337 A1 * 2/2014 Van Wijk ..... E21B 33/06 166/387
2014/0262308 A1 9/2014 McCormick
2016/0010418 A1 * 1/2016 Van Wijk ..... E21B 33/0355 166/363
2016/0138358 A1 * 5/2016 Whitby ..... E21B 33/0355 166/363
2016/0329697 A1 * 11/2016 Brooks ..... H01F 7/064

* cited by examiner

SUBSEA DRILLING SYSTEM WITH INTENSIFIER

BACKGROUND

This section is intended to introduce the reader to various aspects of art that may be related to various aspects of the presently described embodiments. This discussion is believed to be helpful in providing the reader with background information to facilitate a better understanding of the various aspects of the described embodiments. Accordingly, it should be understood that these statements are to be read in this light and not as admissions of prior art.

In most offshore drilling operations, a wellhead at the sea floor is positioned at the upper end of the subterranean wellbore lined with casing, a blowout preventer ("BOP") stack is mounted to the wellhead and a lower marine riser package ("LMRP") is mounted to the BOP stack. The upper end of the LMRP typically includes a flex joint coupled to the lower end of a drilling riser that extends upward to a drilling vessel at the sea surface. A drill string is hung from the drilling vessel through the drilling riser, the LMRP, the BOP stack and the wellhead into the wellbore.

During drilling operations, drilling fluid, or mud, is pumped from the sea surface down the drill string, and returns up the annulus around the drill string. In the event of a rapid invasion of formation fluid into the annulus, commonly known as a "kick," the BOP stack and/or LMRP may actuate to help seal the annulus and control the fluid pressure in the wellbore. In particular, the BOP stack and the LMRP include closure members, or cavities, designed to help seal the wellbore and prevent the release of high-pressure formation fluids from the wellbore. Thus, the BOP stack and LMRP function as pressure control devices.

For most subsea drilling operations, hydraulic fluid for operating the BOP stack and the LMRP is provided using a common control system physically located on the surface drilling vessel. However, as a backup, or even possibly a primary means of operation, hydraulic fluid accumulators located subsea are filled with hydraulic fluid under pressure. The amount and size of the accumulators depends on the anticipated operation specifications for the well equipment.

An example of an accumulator includes a piston accumulator, which includes a hydraulic fluid section and a gas section separated by a piston movable within the accumulator. The hydraulic fluid is placed into the fluid section of the accumulator and pressurized by injecting gas (typically inert gas, e.g., nitrogen) into the gas section. The fluid section is connected to a hydraulic circuit so that the hydraulic fluid may be used to operate the well equipment. As the fluid is discharged, the piston moves within the accumulator under pressure from the gas to maintain pressure on the remaining hydraulic fluid until full discharge.

The ability or capacity of the accumulator to operate a piece of equipment depends on the amount of hydraulic fluid in the accumulator and the pressure of the gas. Subsea accumulators may be charged with pressure by a pumping system on the surface drilling vessel and are limited by the pressure capacity rating for the system, e.g., 5,000 psi (34,473.79 kPa). However, as water depth increases, accumulators become less efficient. For example, if the drilling site lies deeper than 10,000 ft (3,048 m) of water, the hydrostatic pressure will exceed 5000 psi. At that depth, colder temperatures reduce the nitrogen precharge in the accumulators. Therefore, the hydraulic fluid must be pumped into the accumulator at the correct working pressure and with the hydrostatic pressure taken into consideration.

Consequently, with high operating pressures and a reduced precharge from colder temperatures, only a small percentage of the nominal volume is available for usable pressurized fluid.

The ability to charge up the subsea accumulators to pressure greater than 5,000 psi (34,473.79 kPa) can improve the accumulator volumetric efficiency. Systems may be built to include a special hotline reel with the ability to provide supply fluid under higher pressure than 5,000 psi (34,473.79 kPa) and this reel is connected to the BOP stack. This hotline system requires a separate hose reel located on the surface in the rig moon pool area, which can already be crowded with other equipment. There must also be a separate set of high pressure pumps to generate the high pressure fluid. The hose is run down the riser and a hydraulically operated stab assembly is used to allow communication of the high pressure fluid from the BOP stack LMRP to the lower stack where the subsea accumulators are located. This additional equipment requires maintenance and inspection to continue to operate reliably.

BRIEF DESCRIPTION OF THE DRAWINGS

For a detailed description of the embodiments of the invention, reference will now be made to the accompanying drawings in which.

DETAILED DESCRIPTION

Figure 1:
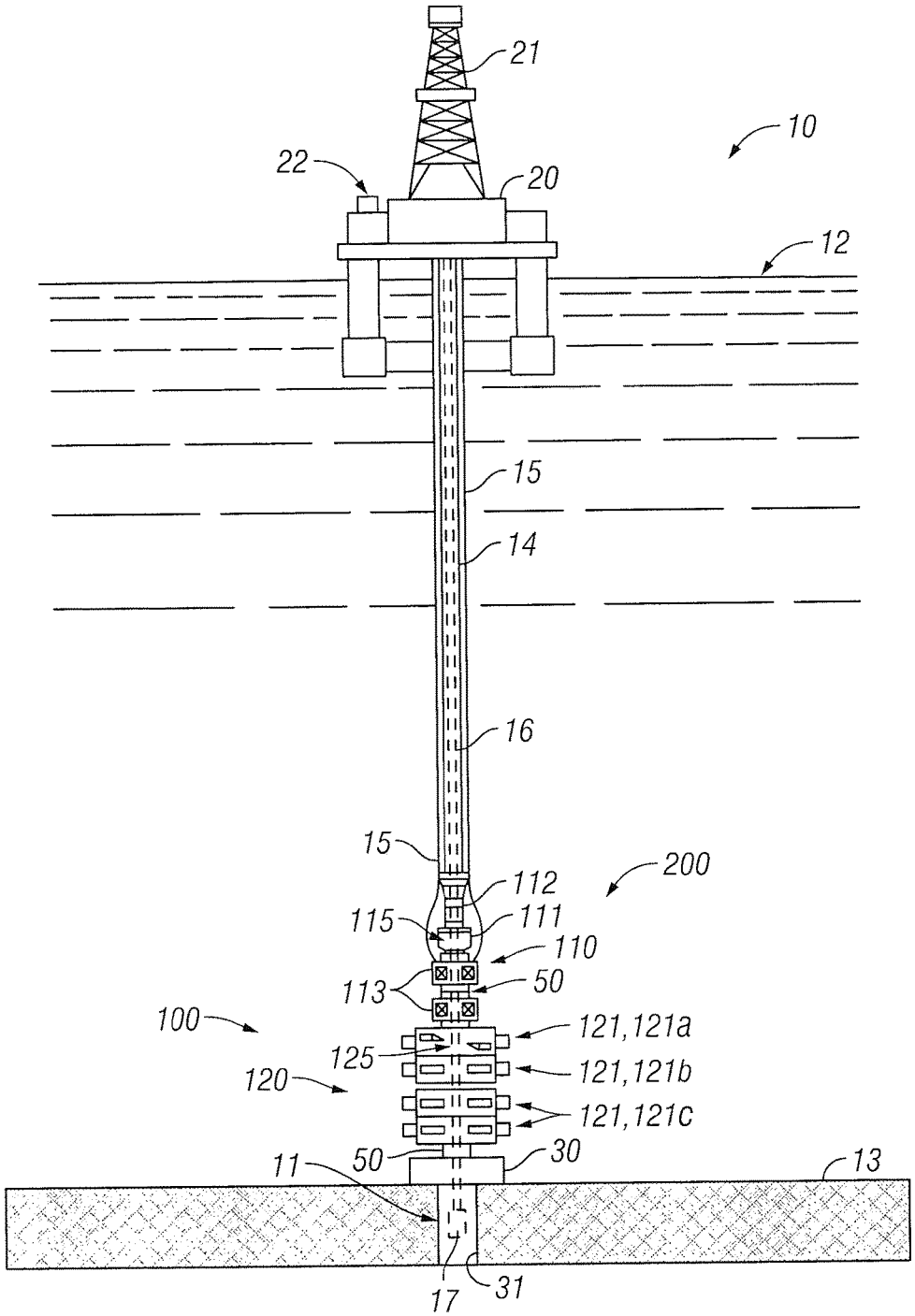
FIG. 1 is a schematic view of an offshore system for drilling and/or producing a subterranean wellbore according to one or more embodiments of the present disclosure.

Referring now to FIG. 1, an embodiment of an offshore system 10 for drilling and/or producing a wellbore 11 is shown. In this embodiment, the system 10 includes an offshore vessel or platform 20 at the sea surface 12 and a subsea BOP stack assembly 100 mounted to a wellhead 30 at the sea floor 13. The platform 20 is equipped with a derrick 21 that supports a hoist (not shown). A tubular drilling riser 14 extends from the platform 20 to the BOP stack assembly 100. The riser 14 returns drilling fluid or mud to the platform 20 during drilling operations. One or more hydraulic conduits 15 extend along the outside of the riser 14 from the platform 20 to the BOP stack assembly 100. The one or more hydraulic conduits 15 supply pressurized hydraulic fluid to the assembly 100. Casing 31 extends from the wellhead 30 into the subterranean wellbore 11.

Downhole operations are carried out by a tubular string 16 (for example, drill string, tubing string, coiled tubing, etc.) that is supported by the derrick 21 and extends from the platform 20 through the riser 14, through the BOP stack assembly 100 and into the wellbore 11. A downhole tool 17 is connected to the lower end of the tubular string 16. In general, the downhole tool 17 may comprise any suitable downhole tools for drilling, completing, evaluating and/or producing the wellbore 11 including, without limitation, drill bits, packers, cementing tools, casing or tubing running tools, testing equipment, perforating guns, and the like.

During downhole operations, the string 16, and hence the tool 17 coupled thereto, may move axially, radially and/or rotationally relative to the riser 14 and the BOP stack assembly 100.

Figure 2:
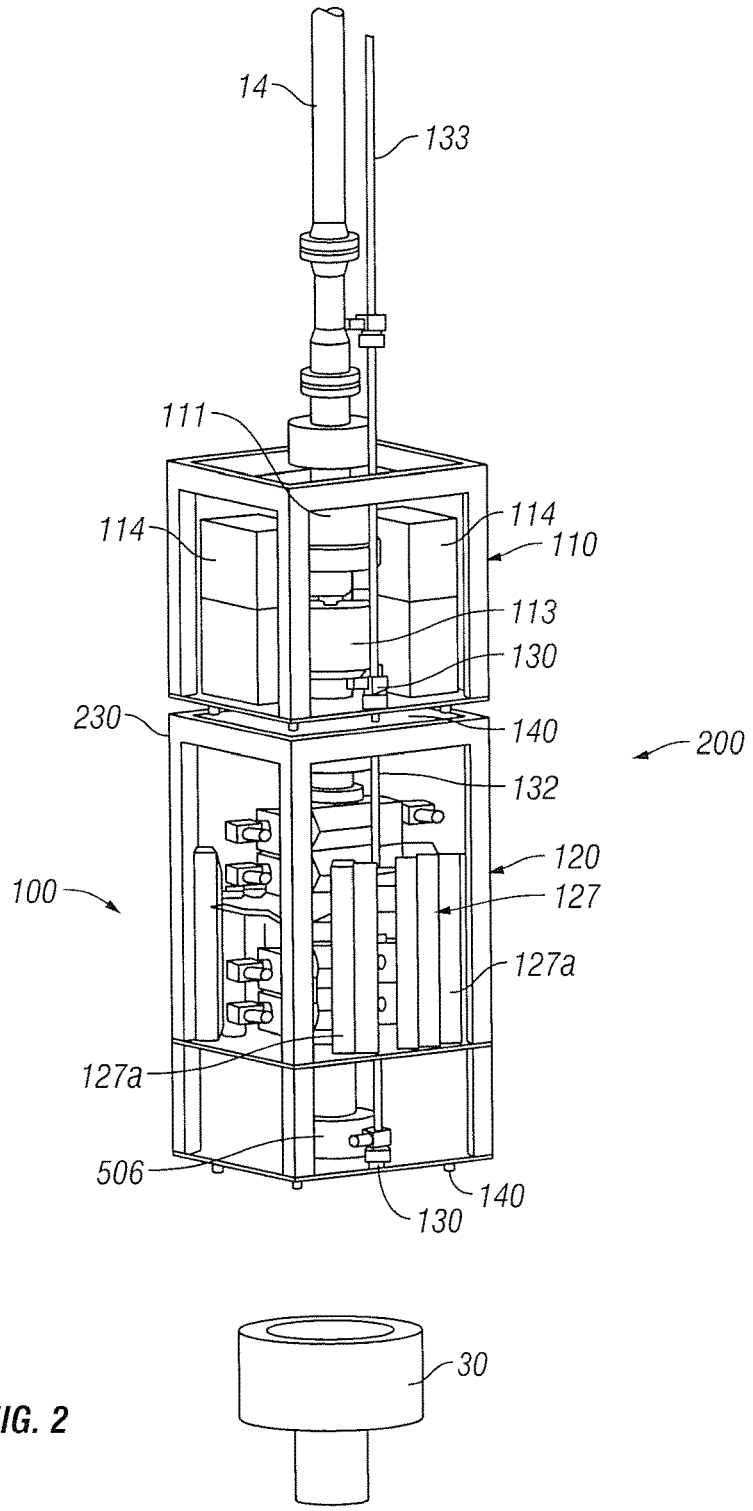
FIG. 2 is a perspective view of a subsea BOP stack assembly and measurement system according to one or more embodiments of the present disclosure.

Referring now to FIGS. 1 and 2, the BOP stack assembly 100 is mounted to the wellhead 30 and is designed and configured to control and seal the wellbore 11, thereby containing the hydrocarbon fluids (i.e., liquids and gases) therein. In this embodiment, the BOP stack assembly 100 comprises a lower marine riser package (LMRP) 110 and a BOP or BOP stack 120.

The BOP stack 120 is releasably secured to the wellhead 30 as well as the LMRP 110 and the LMRP 110 is releasably secured to the BOP stack 120 and the riser 14. In this embodiment, the connections between the wellhead 30, the BOP stack 120 and the LMRP 110 include hydraulically actuated, mechanical wellhead-type connections 50. In general, the connections 50 may comprise any suitable releasable wellhead-type mechanical connection such as the DWHC or HC profile subsea wellhead system available from Cameron® International Corporation of Houston, Tex., or any other such wellhead profile available from several subsea wellhead manufacturers. Typically, such hydraulically actuated, mechanical wellhead-type connections (for example, the connections 50) include an upward-facing male connector or "hub" that is received by and releasably engages a downward-facing mating female connector or receptacle 50*b*. In this embodiment, the connection between LMRP 110 and the riser 14 is a flange connection that is not remotely controlled, whereas the connections 50 may be remotely, hydraulically controlled.

Referring still to FIGS. 1 and 2, the LMRP 110 includes a riser flex joint 111, a riser adapter 112, an annular BOP 113 and a pair of redundant control units or pods 114. A flow bore 115 extends through the LMRP 110 from the riser 14 at the upper end of the LMRP 110 to the connection 50 at the lower end of the LMRP 110. The riser adapter 112 extends upward from the flex joint 111 and is coupled to the lower end of the riser 14. The flex joint 111 allows the riser adapter 112 and the riser 14 connected thereto to deflect angularly relative to the LMRP 110 while wellbore fluids flow from the wellbore 11 through the BOP stack assembly 100 into the riser 14. The annular BOP 113 comprises an annular elastomeric sealing element that is mechanically squeezed radially inward to seal on a tubular extending through the LMRP 110 (for example, the string 16, casing, drillpipe, drill collar, etc.) or seal off the flow bore 115. Thus, the annular BOP 113 has the ability to seal on a variety of pipe sizes and/or profiles, as well as perform a complete shut-off ("CSO") to seal the flow bore 115 when no tubular is extending therethrough.

In this embodiment, the BOP stack 120 comprises an annular BOP 113 as previously described, choke/kill valves 131 and choke/kill lines 132. The choke/kill line connections 130 connect the female choke/kill connectors of the LMRP 110 with the male choke/kill adapters of the BOP stack 120, thereby placing the choke/kill connectors of the LMRP 110 in fluid communication with the choke lines 132 of the BOP stack 120. A main bore 125 extends through the BOP stack 120. In addition, the BOP stack 120 includes a plurality of axially stacked ram BOPs 121. Each ram BOP 121 includes a pair of opposed rams and a pair of actuators 126 that actuate and drive the matching rams. In the illustrated embodiment, the BOP stack 120 includes four ram BOPs 121—an upper ram BOP 121 including opposed blind shear rams or blades 121*a* for severing the tubular string 16 and sealing off the wellbore 11 from the riser 14, and the three lower ram BOPs 121 including the opposed pipe rams 121*c* for engaging the string 16 and sealing the annulus around the tubular string 16. In other embodiments, the BOP stack 120 may include a different number of rams, different types of rams, one or more annular BOPs or combinations thereof. As will be described in more detail below, the control pods 114 operate the valves 131, the ram BOPs 121 and the annular BOPs 113 of the LMRP 110 and the BOP stack 120.

The opposed rams 121*a,c* are located in cavities that intersect the main bore 125 and support the rams 121*a,c* as they move into and out of the main bore 125. Each set of rams 121*a,c* is actuated and transitioned between an open position and a closed position by matching actuators 126. In particular, each actuator 126 hydraulically moves a piston within a cylinder to move a connecting rod coupled to one ram 121*a, c*. In the open positions, the rams 121*a,c* are radially withdrawn from the main bore 125. However, in the closed positions, the rams 121*a,c* are radially advanced into the main bore 125 to close off and seal the main bore 125 and/or the annulus around the tubular string 16. The main bore 125 is substantially coaxially aligned with the flow bore 115 of the LMRP 110, and is in fluid communication with the flow bore 115 when the rams 121*a,c* are open.

As shown in FIG. 2, the BOP stack 120 also includes a set or bank 127 of hydraulic accumulators 127*a* mounted on the BOP stack 120. While the primary hydraulic pressure supply is provided by the hydraulic conduits 15 extending along the riser 14, the accumulator bank 127 may be used to support operation of the rams 121*a, c* (i.e., supply hydraulic pressure to the actuators 126 that drive the rams 121*a, c* of the stack 120), the choke/kill valves 131, the connector 50*b* of the BOP stack 120 and the choke/kill connectors 130 of the BOP stack 120.

As previously described, in this embodiment, the BOP stack 120 includes one annular BOP 113 and four sets of rams (one set of shear rams 121*a*, and three sets of pipe rams 121*b, c*). However, in other embodiments, the BOP stack 120 may include different numbers of rams, different types of rams, different numbers of annular BOPs (e.g., annular BOP 113) or combinations thereof. Further, although the LMRP 110 is shown and described as including one annular BOP 113, in other embodiments, the LMRP (e.g., LMRP 110) may include a different number of annular BOPs (e.g., two sets of annular BOPs 113). Further, although the BOP stack 120 may be referred to as a "stack" because it contains a plurality of ram BOPs 121 in this embodiment, in other embodiments, BOP 120 may include only one ram BOP 121.

Although the control pods 114 may be used to operate the BOPs 121 and the choke/kill valves 131 of the BOP stack 120 in this embodiment, in other embodiments, the BOPs 121 and the choke/kill valves 131 may also be operated by one or more subsea remotely operated vehicles ("ROVs").

The pair of redundant control pods 114 are multiplexer (MUX) control units, each with subsea electronic modules (SEMs). The control pods 114 may be connected to a surface control unit 22 (FIG. 1) with a MUX umbilical or any other suitable type of communication link. In addition to controlling other equipment on the LMRP 110 and BOP stack 120, computer logic 302 in the control pod 114 SEMs may also be used to control one or more intensifiers 230 shown in FIG. 2 and in more detail in FIG. 3. Each intensifier 230 is in fluid communication with one or more of the stack accumulators 127*a* and, as explained below, intensifies hydraulic pressure from the surface drilling vessel to provide fluid to charge the one or more accumulators 127*a* while in the subsea environment.

Figure 3:
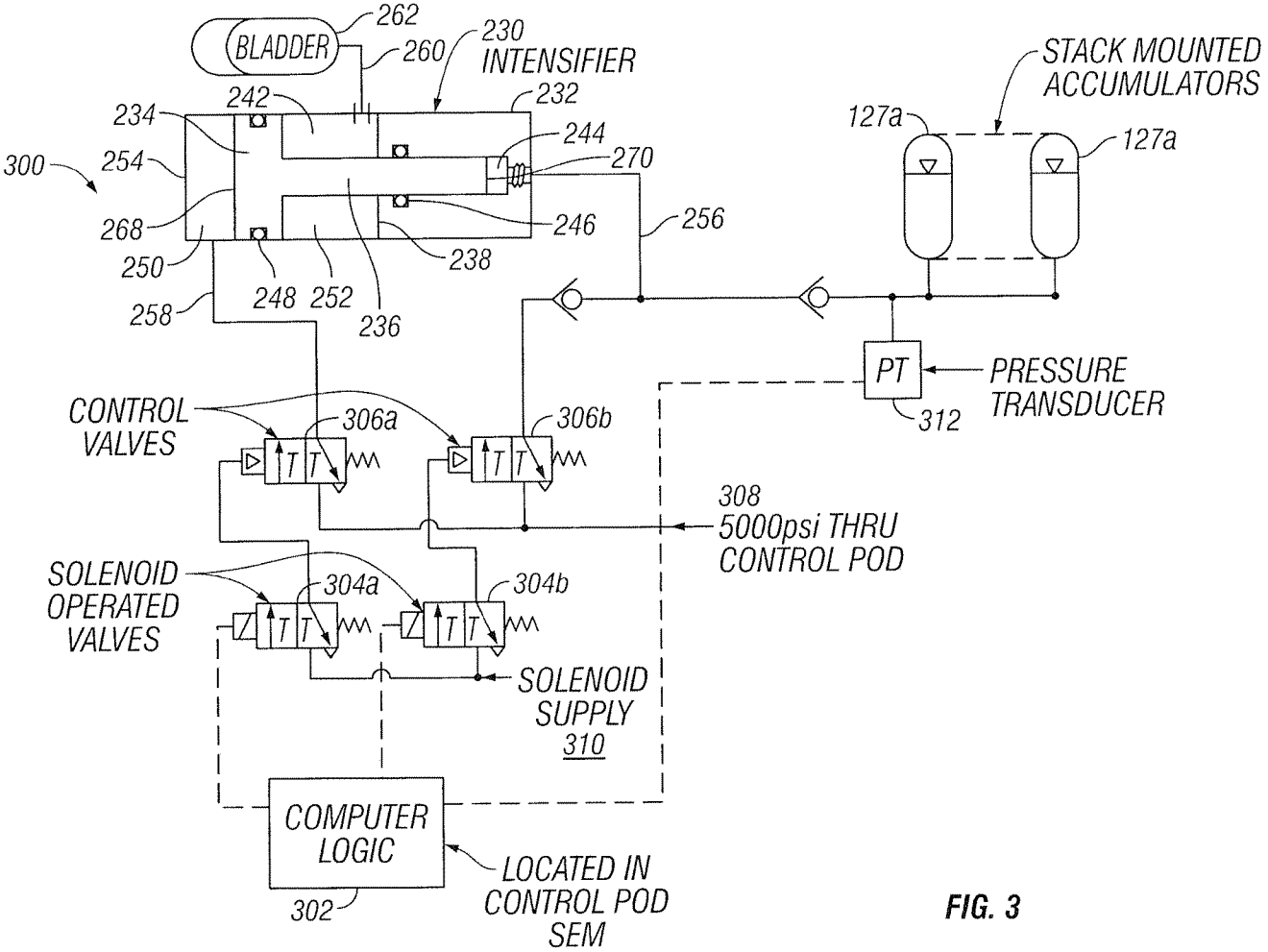
FIG. 3 is schematic diagram of an embodiment of a control system according to one or more embodiments of the present disclosure.

A schematic diagram of an embodiment of a control system 300 with an intensifier 230 is shown in FIG. 3. As shown in FIG. 3, an intensifier 230 is in fluid communication with multiple accumulators 127*a* through a fluid coupling that may be, for example, a pipe, a hose, or other suitable fluid conduit. The intensifier 230 can be mounted anywhere on the BOP stack 120 or the LMRP 110 and includes a housing 232, a piston 234, and a mandrel 236. The diameter of the mandrel 236 is less than the diameter of the piston 234. The housing 232 includes an internal wall 238 that divides the interior of the housing 232 into a piston chamber 242 and a mandrel chamber 244. The internal wall 238 includes a port through which the mandrel 236 travels between the piston chamber 242 and the mandrel chamber 244. A seal 246 sealingly engages the mandrel 236. The internal wall 238 in conjunction with the mandrel 236 and the seal 246 hydraulically isolate the mandrel chamber 244 and the piston chamber 242.

A piston seal 248 circumferentially surrounds the piston 234 and sealingly engages the interior surface of the housing 232. The engagement of the piston seal 248 with the interior surface of the piston chamber 242 divides the piston chamber 242 into two hydraulically isolated chambers—closing chamber 250 and slack chamber 252. The intensifier closing chamber 250 is formed between end plate 254 and piston seal 248. The slack chamber 252 is formed between the internal wall 238 and the piston seal 248.

In general, hydraulic fluid is introduced into the intensifier closing chamber 250 via a closing line 258 to communicate a force and move the mandrel 236 to travel towards the mandrel chamber 244. Hydraulic fluid is communicated into or out of the mandrel chamber 244 via an opening line 256.

The housing 232 may also include a slack chamber line 260 that allows fluid communication with the slack chamber 252. A source of reduced fluid pressure may be coupled to the slack chamber 252 via the slack chamber line 260. For example, a bladder 262 may be coupled to the slack chamber 252 via the slack chamber line 260.

The intensifier 230 increases the force applied from fluid pressure through the closing line 258. The difference in area of the intensifier piston surface 268 and the mandrel surface 270 results in the force communicated from the mandrel 236 being greater than the force applied to the piston 234 at a given fluid pressure. The force applied, and thus the pressure on the fluid in the mandrel chamber 244 is proportional to the size of the piston surface 268 compared to the mandrel surface 270. Thus, the intensifier 230 can be used to intensify a given fluid pressure supplied by a surface pumping system such that the equipment requirements for the surface vessel 20 pumping equipment and the accumulators 127*a* are not as robust. The intensifier 230 also possibly alleviates the need for more and/or larger accumulators 127*a*, etc. In this way, the intensifier 230 operates as a pump to increase the fluid pressure of fluid for delivery to the accumulators 127*a* and relieve the requirements of providing the higher pressure strictly from pumps on the surface vessel 20.

The flow of fluid through the opening line 256 and/or the closing line 258 may be regulated by the hydraulic control system 300 that includes various fluid switches (i.e. valves) coupled to fluid sources/receptacles. As shown in FIG. 3, hydraulic fluid from the surface drilling vessel may be provided through the control pod 114 on the LMRP 110 at inlet 308. The communication of this hydraulic fluid to, and thus the operation of, the intensifier 230 is controlled by closing line control valve 306*a* and opening line control valve 306*b*. The control valves 306*a* and 306*b* are controlled by closing solenoid valve 304*a* and opening solenoid valve 304*b*, respectively, which themselves are controlled using computer logic 302 in the operating system of the SEMs in the control pods 114. Control fluid is sourced to the solenoid valves 304*a* and 304*b* at the solenoid inlet 310. The computer logic 302 uses data from a pressure transducer 312 that measures the pressure in the fluid line connecting the accumulators 127*a*.

As an example of operation, the pressure transducer 310 may communicate a signal to the control pods 114 that the pressure in the accumulators 127*a* needs to be increased. The control pods 114 may then control the control valves 306*a* and 306*b* to communicate pressure to the mandrel chamber 244 and move the piston 236 into the closing chamber 250 if not already in that position. This fluid pressure from the surface is also communicated to the accumulators 127*a* to charge them with the pressure provided from the surface, for example 5,000 psi (34,473.79 kPa).

To increase the pressure in the accumulators 127*a* even more than provided by the surface vessel equipment, the control pods 114 are used to operate the control valves 304*a* and 304*b* to communicate the fluid from the surface to the closing chamber 250 of the intensifier 230. Because of the surface area differential of the intensifier piston 236, the force and thus the pressure applied to the fluid in the mandrel chamber 244 is increased above the fluid pressure provided by the surface equipment and this increased pressure is then communicated to the accumulators 127*a* to charge the accumulators 127*a* to a pressure above the pressure provided by the surface pumping equipment. For example, the accumulators 127*a* may be charged to at least 7,500 psi (51,710.68 kPa). The amount of fluid and pressure of the fluid discharged from the intensifier 230 can be designed into the size of the intensifier 230 components so as to be able to rapidly charge the subsea accumulators 127*s*.

This process may be repeated by resetting the intensifier mandrel 236 toward the end plate 254 of the closing chamber 250 and then causing the mandrel 236 to stroke toward the mandrel chamber 244 as described above. In this repeated fashion, the intensifier 230 may be used as a pump to increase the pressure in the accumulators 127*a* above what would otherwise be provided using pressure from surface pumping equipment alone. The intensifier 230 is controlled using the control pods 114 and additional control valves and mechanisms are not needed. This enables the control system 300 to be more robust and simplistic and thus more reliable.

Figure 4:
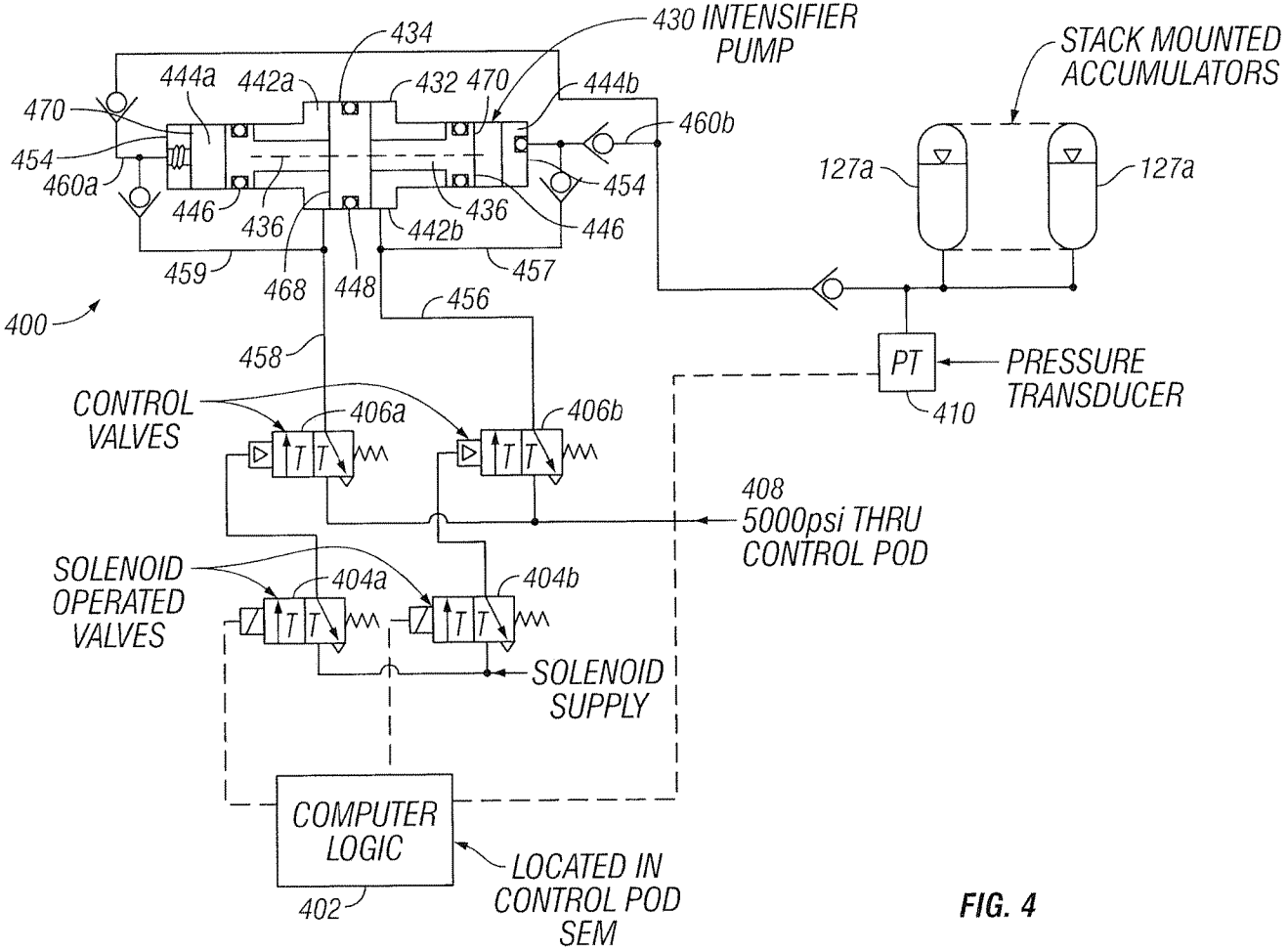
FIG. 4 is a schematic diagram of another embodiment of a control system according to one or more embodiments of the present disclosure.

A schematic diagram of another embodiment of a control system 400 with an intensifier 430 is shown in FIG. 4. As shown in FIG. 4, an intensifier 430 is in fluid communication with multiple accumulators 127*a* through a fluid coupling that may be, for example, a pipe, a hose, or other suitable fluid conduit. The intensifier 430 can be mounted anywhere on the BOP stack 120 or the LMRP 110 and includes a housing 432, a piston 434, and mandrels 436 extending laterally from both sides of the piston 434. The diameter of the mandrels 436 is less than the diameter of the piston 434.

A piston seal 448 circumferentially surrounds the piston 434 and sealingly engages the interior surface of the housing 432. Mandrel seals 446 sealingly engage each mandrel 436. The piston 434 divides the interior of the housing 432 into two piston chambers 442*a,b* located between the piston seal 448 and the mandrel seals 446. Additionally, the mandrels 436 form two mandrel chambers 444*a,b* between the mandrel seals 446 and the end walls 454. The piston chambers 442*a,b* and the mandrel chambers 444*a,b* are hydraulically isolated chambers due to the engagement of the piston seal 448 and the mandrel seals 446 with the housing 432.

As an example of operation, a pressure transducer 410 may communicate a signal to the control pods 114 that the pressure in the accumulators 127*a* needs to be increased. Hydraulic fluid from the surface at inlet 408 is then introduced into the piston chamber 442*a* via a first line 458 to communicate a force and move the piston 434 and the mandrels 436 to travel towards the mandrel chamber 444*b*. To do this, the control pods 114 may close the control valve 406*b* and open the control valve 406*a*. At the same time, hydraulic fluid is introduced into the mandrel chamber 444*a* through a first line split 459. This both pumps fluid out of the mandrel chamber 444*b* and primes mandrel chamber 444*a* for pumping in a reverse cycle. The fluid pressure from the surface is also communicated to the accumulators 127*a* to charge them with the pressure provided from the surface, for example, 5,000 psi (34,473.70 kPa).

To reverse the cycle, the control valve 406*a* is closed and the control valve 406*b* is opened. Hydraulic fluid is then introduced into the piston chamber 442*b* via a second line 456 to communicate a force and move the piston 434 and the mandrels 436 towards the opposite mandrel chamber 444*a*. At the same time, hydraulic fluid is introduced into the mandrel chamber 444*b* through a second line split 457. This both pumps fluid out of the mandrel chamber 444*a* and primes mandrel chamber 444*b* for pumping in a reverse cycle. If the surface pressure is great enough, the fluid pressure from the surface is also communicated to the accumulators 127*a* to charge them with the pressure provided from the surface, for example, 5,000 psi (34,473.70 kPa). However, if the surface pressure is less than that in the accumulators 127*a*, the pressure in the accumulators is not allowed to be released. It should be noted that the piston 434 and the mandrel 436 can be moved first in either direction and that this is only one example.

In this manner, hydraulic fluid is communicated out of the mandrel chambers 444*a,b* via opening lines 460*a,b* as the piston 434 and the mandrels 436 move toward the respective mandrel chambers 444,*a,b*. In doing so, the intensifier 430 increases the force applied from the fluid pressure from the surface through the first line 458 and the second line 456. The difference in area of the intensifier piston surface 468 and the mandrel surfaces 470 results in the force communicated from the mandrels 436, and thus the pressure of the fluid leaving the mandrel chambers 444*a,b*, being greater than the force applied to the piston 434 at a given fluid pressure. The force applied, and thus the pressure on the fluid in the mandrel chambers 444*a,b* is proportional to the size of the piston surface 468 compared to the mandrel surfaces 470. Thus, the intensifier 430 can be used to intensify a given fluid pressure supplied by a surface pumping system such that the equipment requirements for the surface vessel 20 pumping equipment and the accumulators 127*a* are not as robust. For example, the accumulators 127*a* may be charged to at least 7,500 psi (51,710.68 kPa). The amount of fluid and pressure of the fluid discharged from the intensifier 430 can be designed into the size of the intensifier 430 components so as to be able to rapidly charge the subsea accumulators 127*s*. The intensifier 430 possibly alleviates the need for more and/or larger accumulators 127*a*, etc. In this way, the intensifier 430 operates as a pump to increase the fluid pressure of fluid for delivery to the accumulators 127*a* and relieve the requirements of providing the higher pressure strictly from pumps on the surface vessel 20. Additionally, the intensifier 430 is controlled using the control pods 114 and additional control valves and mechanisms are not needed. This enables the control system 400 to be more robust and simplistic and thus more reliable.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A subsea drilling system comprising:

a blowout preventer (BOP) stack including an accumulator, the accumulator comprising an interior configured to store pressurized fluid usable for operation of the BOP stack;

an intensifier in fluid communication with the interior of the accumulator, the intensifier comprising:

a housing;

a piston and a mandrel cyclable within the housing;

wherein a surface area of the piston is greater than a surface area of the mandrel; and wherein a pressure communicated to the piston is communicated from the mandrel at a pressure increased by an amount proportional to the difference between the piston surface area and the mandrel surface area; and a control system locatable subsea at least partially within a control pod, the control system configured to control the intensifier to increase the pressure in the interior of the accumulator by cycling the piston and mandrel within the housing to pump fluid from a fluid source into the interior of the accumulator;

wherein the control system is configured to control the intensifier by controlling a first control valve that is configured to enable flow of fluid from the fluid source to a closing chamber of the intensifier and into contact with the piston when the first control valve is in a respective open position.

2. The system of claim 1, further comprising a lower marine riser package (LMRP) comprising the control system.

3. The system of claim 1, the control system further comprising:

a pressure transducer configured to communicate a signal indicative of pressure in the interior of the accumulator to the control pod; and a processor in the control pod configured to perform logical operations to operate control valves comprising the first control valve.

4. The system of claim 3, wherein the control valves comprise a second control valve that is configured to enable flow of fluid from the fluid source to a mandrel chamber of the intensifier and to the interior of the accumulator when the second control valve is in a respective open position.

5. The system of claim 4, wherein the control system is configured to control the first control valve to a respective closed position and the second control valve to the respective open position to block the flow of fluid to the closing chamber and to enable the flow of fluid to the mandrel chamber and to the interior of the accumulator, and subsequently to control the first control valve to the respective open position and the second control valve to a respective closed position to enable the flow of fluid to the closing chamber and to block the flow of fluid to the mandrel chamber and to the interior of the accumulator, thereby cycling the piston and the mandrel within the housing to increase the pressure in the interior of the accumulator.

6. The system of claim 5, wherein the mandrel chamber of the intensifier is in fluid communication with the interior of the accumulator to enable fluid within the mandrel chamber of the intensifier to flow into the interior of the accumulator as the first control valve moves to the respective open position while the second control valve is in the respective closed position.

7. The system of claim 1, further comprising multiple accumulators.

8. The system of claim 1, further comprising multiple intensifiers.

9. The system of claim 1, further comprising pumping equipment at a sea surface configured to communicate fluid to the intensifier and to the interior of the accumulator through the control pod, and wherein the intensifier is configured to increase the pressure in the interior of the accumulator above the pressure provided by the pumping equipment.

10. The system of claim 1, wherein the closing chamber and a mandrel chamber of the intensifier are configured to receive pressure from pumping equipment at a sea surface.

11. The system of claim 1, wherein the piston comprises two sides and further comprising mandrels laterally extended from both sides of the piston, and the piston and mandrels are configured to move in one direction upon a force communicated to one side of the piston and in an opposite direction upon a force communicated to the other side of the piston.

12. The system of claim 1, wherein the piston comprises two sides and further comprising mandrels laterally extended from both sides of the piston, and the piston and mandrels are configured to move in one direction upon a force communicated to one side of the piston and in an opposite direction upon a force communicated to the other side of the piston.

13. A subsea system comprising:

an accumulator, the accumulator comprising an interior configured to store pressurized fluid usable for operation of a BOP stack;

an intensifier in fluid communication with the interior of the accumulator, the intensifier comprising:

a piston and a mandrel cyclable within a housing;

wherein a surface area of the piston is greater than a surface area of the mandrel; and wherein a pressure communicated to the piston is communicated from the mandrel at a pressure increased by an amount proportional to the difference between the piston surface area and the mandrel surface area; and a control system locatable subsea at least partially within a control pod, the control system configured to control the intensifier to increase the pressure in the interior of the accumulator by cycling the piston within the housing to pump fluid into the interior of the accumulator;

wherein the control system is configured to control the intensifier by controlling a first control valve that is configured to enable fluid flow to a closing chamber of the intensifier when the first control valve is in a respective open position and by controlling a second control valve that is configured to enable fluid flow to a mandrel chamber of the intensifier and to the interior of the accumulator when the second control valve is in a respective open position.

14. The system of claim 13, further comprising a plurality of control pods.

15. The system of claim 13, further comprising:

a pressure transducer configured to communicate a signal indicative of pressure in in the interior of the accumulator to the control pod; and a processor configured to perform logical operations to operate the first and second control valves.

16. The system of claim 15, wherein the first control valve is positioned to enable fluid flow from a fluid source to the closing chamber, and the second control valve is positioned to enable fluid flow from the fluid source to the mandrel chamber and the interior of the accumulator.

17. The system of claim 13, further comprising multiple accumulators.

18. The system of claim 13, further comprising pumping equipment at a sea surface configured to communicate fluid to the intensifier and to the interior of the accumulator through the control pod and wherein the intensifier is configured to increase the pressure in the interior of the accumulator above the pressure provided by the pumping equipment.

19. The system of claim 13, wherein the closing chamber and the mandrel chamber of the intensifier are configured to receive pressure from pumping equipment at the surface.

20. The system of claim of claim 13, comprising a fluid line extending from the second control valve toward the intensifier and the accumulator, wherein the fluid line splits upstream of the intensifier and the accumulator to enable fluid flow to the mandrel chamber of the intensifier and to the interior of the accumulator when the second control valve is in the respective open position.

* * * * *